US005816964A

United States Patent [19]

Ainslie et al.

[11] Patent Number: 5,816,964

[45] Date of Patent: Oct. 6, 1998

[54] PUCK FOR PLAYING OF HOCKEY AND HOCKEY-LIKE GAMES ON A VARIETY OF PLAYING SURFACES

[76] Inventors: Ross Ainslie, c/o Spryfield Animal Hospital, 171 Herring Cove Road, Halifax Nova Scotia, Canada, B3P 1K9; Karl Rotter, 116 Pinecrest Drive, Dartmouth Nova Scotia, Canada, B3A 2J9

[21] Appl. No.: 834,630

[22] Filed: Apr. 14, 1997

[30] Foreign Application Priority Data

Apr. 19, 1996 [CA] Canada ..... 2174579

[51] Int. Cl.[6] ..... A63B 67/00

[52] U.S. Cl. ..... 473/588

[58] Field of Search ..... 473/587, 588, 473/589, 229

[56] References Cited

U.S. PATENT DOCUMENTS

| | | | |
|---|---|---|---|
| 2,494,929 | 1/1950 | Colaluca | 473/588 |
| 2,727,744 | 12/1955 | Watson . | |
| 3,784,204 | 1/1974 | Felber . | |
| 4,153,253 | 5/1979 | White, Sr. | 473/588 |
| 4,555,114 | 11/1985 | Dozier . | |
| 4,793,769 | 12/1988 | Dolan . | |
| 4,801,144 | 1/1989 | DeMasi, Jr. et al. . | |
| 5,014,990 | 5/1991 | Kaser et al. | 473/588 |
| 5,240,251 | 8/1993 | Filice . | |
| 5,284,343 | 2/1994 | Bigornia et al. | 473/588 X |
| 5,288,072 | 2/1994 | Hsieh | 473/588 |
| 5,518,237 | 5/1996 | Bellehumeur | 473/588 |
| 5,531,442 | 7/1996 | Gill | 473/588 |

FOREIGN PATENT DOCUMENTS

| | | |
|---|---|---|
| 876879 | 7/1971 | Canada . |
| 904368 | 7/1972 | Canada . |
| 935453 | 10/1973 | Canada . |
| 1209165 | 8/1986 | Canada . |
| 2055104 | 5/1993 | Canada . |

*Primary Examiner*—Raleigh W. Chiu
*Attorney, Agent, or Firm*—Killworth, Gottman, Hagan & Schaeff LLP

[57] ABSTRACT

A puck for playing hockey and hockey-like games on a variety of surfaces. The puck has a body of generally cylindrical shape with opposed major faces and an internal chamber therein containing a mass which is movable within the chamber whereby the center of gravity of the puck can be altered, as by application of a force to the puck in a direction generally parallel to the major faces. The puck body includes mating halves held together by a resilient band extending around the cylindrical sidewall of the body, the band having spaced ribs thereon mating with associated grooves in the sidewalls of the mating halves.

3 Claims, 2 Drawing Sheets

PUCK FOR PLAYING OF HOCKEY AND HOCKEY-LIKE GAMES ON A VARIETY OF PLAYING SURFACES

FIELD OF THE INVENTION

This invention relates to an improved puck for use in playing hockey and hockey-like games on a variety of playing surfaces, including ice.

BACKGROUND OF THE INVENTION (a) Background of the Invention Regarding On-Ice Playing of Hockey Considering ice hockey historically, the sport originated as a Canadian game, which game has since spread to many places in the world. Currently, the puck used in ice hockey is a standard high density circular rubberized disc with flat, smooth sides and a patterned edge of which the latter provides a degree of friction to assist in propulsion by the blade of the player's stick. At the end of each period in regular hockey, the ice is cleaned of loose "snow" and prepared for the next period by applying moisture to create a new smooth frozen surface. At the beginning of a game or a playing period, a regular standard puck moves fairly freely with a certain amount of friction. However, very early in the period, crystals of ice or "snow" are shaved off the surface due to activity of the skate blades of the players. This "snow" creates more friction on the lower face side of the puck and requires more effort and dexterity on the part of the players to stick handle and direct the puck in the desired manner and distance.

A left wing hockey player shooting left handed can shoot the puck over the blue line into the left side of the opposing end with a counter clockwise spin causing it to follow the boards around with a minimum amount of friction from contact of the puck edges with the boards due to the direction of the spin. Face surface friction of the puck will be minimized by the speed of spinning of the puck as it makes its way from left corner to right side of the rink. The distance the puck travels under these circumstances will depend on the force of the shot, the direction of rotation, the number of spins per second, the condition of the face surface of the puck and the condition of the ice surface at the time of the shooting. Before each major hockey game, pucks are placed in a deep freezer to harden the rubber and help minimize friction on the face surface.

The opposite scenario of the above situation takes place when a right wing player shoots a right handed shot along the right side of the opposing end.

The effectiveness and speed of getting a shot away depends on the position of the player's stick in relationship to his body, the effort applied to the manoeuvre, and the condition of the ice surface. In a game of hockey, the prime prerequisites of a good player, in addition to scoring techniques, are the ability to stick handle, pass effectively and receive passes successfully from teammates.

(b) Background of the Invention Regarding Off-Ice Playing of Hockey

In the western hemisphere, ice hockey tends to be concentrated geographically in southern Canada and the northern portions of the United States including parts of California. Because of higher temperatures, regional economic conditions etc. the southern areas of U.S., Mexico, and South America cannot easily maintain ice hockey rinks. In these areas, hockey is played mainly on the streets and gymnasiums using a round ball on other objects completely unlike a regulation ice hockey puck. Such substitutes for ice hockey pucks do not permit the game to be played with a great degree of skill, nor does it provide the players the degree of "feel" for a proper puck to enable them to transpose their off-ice skills to an on-ice situation. Tennis and rubber balls are often used in street hockey. They have a bouncing effect that is difficult to manage by conventional stick handling. When forceful shots are made, much of the energy is absorbed in the soft mass of the ball causing unsatisfactory propulsion.

As might be expected, the prior art reveals a variety of puck designs suitable for ice and off-ice playing conditions. One such puck is disclosed in Canadian Patent 908,678 which puck is alleged to be useful on non-ice surfaces. The puck's major surfaces are concave and the puck is made of a high density polyethylene. The material used and the shapes of the major surfaces are said to provide for a lower coefficient of friction etc. with the playing surface.

Canadian Patent 935,453 describes a road hockey puck having opposing major faces provided with separate disc elements for sliding engagement with a solid surface. These elements may be made of a suitable plastics material.

Published Canadian application 2,055,104 shows a puck having a multiplicity of shallow projections arranged on opposite major surfaces of the puck adjacent the perimeter of same with the surfaces of the puck including the projections coated with a low friction material such as polytetrafluorothylene. A number of advantages are alleged including a reduction in "snowplow effect", it also being stated that the puck "holds more consistently and rapidly on the ice and affords greater control of the puck by the hockey player".

Other Canadian patents include Patent 904,368 to Chiarelli, 876,879 to Berthiaume and 1,209,165 to Kunick. All of these pucks are provided either with weights or with a composite construction thereby to provide ice or floor hockey pucks of greater or lesser weight as compared to the standard weight.

U.S. Pat. Nos. 4,801,144, 4,793,769, 3,784,204 and 2,727,744 disclose various types of hockey pucks including low friction elements such as freely rotatable ball elements for use on non-ice surfaces. U.S. Pat. No. 4,555,114 discloses a table game puck of foam material having surfaces formed of a thin low friction plastic material such as non-woven nylon. U.S. Pat. No. 5,240,251 discloses a puck with thin bristle material on its opposite major surfaces for use on non-ice surfaces.

The above-noted puck designs, although of interest, are not considered to be entirely satisfactory insofar as their performance is concerned under certain playing conditions (including playing surface conditions).

SUMMARY OF THE INVENTION

The basic object of the invention is to provide an improved puck for playing hockey and hockey-like games on a wide variety of playing surfaces including ice.

Another object of the invention is to provide a low friction puck of official size and which incorporates means to assist the puck in maintaining stability when various external forces are applied to it.

A further object is to provide a puck of the character described above incorporating means to assist in preventing injury to players.

Accordingly, the invention in one aspect provides a puck for playing hockey and hockey-like games on a variety of surfaces, said puck having a body of generally cylindrical shape with opposed major faces and having an internal chamber therein containing a mass which is movable within said chamber whereby the centre of gravity of said puck can be altered, as by application of a force to said puck in a direction generally parallel to said major faces.

In a further aspect of the invention said internal chamber is of disc-like outline shape extending generally parallel to the major faces of the puck.

In a still further aspect of the invention said movable mass comprises particulate material which occupies a portion only of the volume defined by said chamber.

In a further aspect of the invention said puck body comprises a pair of mating halves, each having a circular recess therein which, when said halves are brought together, form said internal chamber.

In a still further aspect of the invention said puck body has a generally cylindrical sidewall extending between said major faces, and a resilient band extending tightly around said sidewall and having a spaced pair of annular ribs on an interior surface thereof each engaging a respective groove formed in an associated one of said mating halves.

In a further aspect of the invention said particulate material comprises sand.

In a still further aspect of the invention the body of the puck is of a low friction plastics material.

BRIEF DESCRIPTION OF THE VIEWS OF DRAWINGS

DETAILED DESCRIPTION OF PREFERRED EMBODIMENT

With reference now to the drawings there is shown a low friction puck 10 of "official size", i.e. about three inches in diameter and about one inch in overall thickness. The main body of the puck is formed of moulded polyethylene or polytetrafluoroethylene or other members of these families thus providing a very low coefficient of friction and enabling use of the puck on a variety of playing surfaces while at all times simulating the game of hockey.

Figure 1:
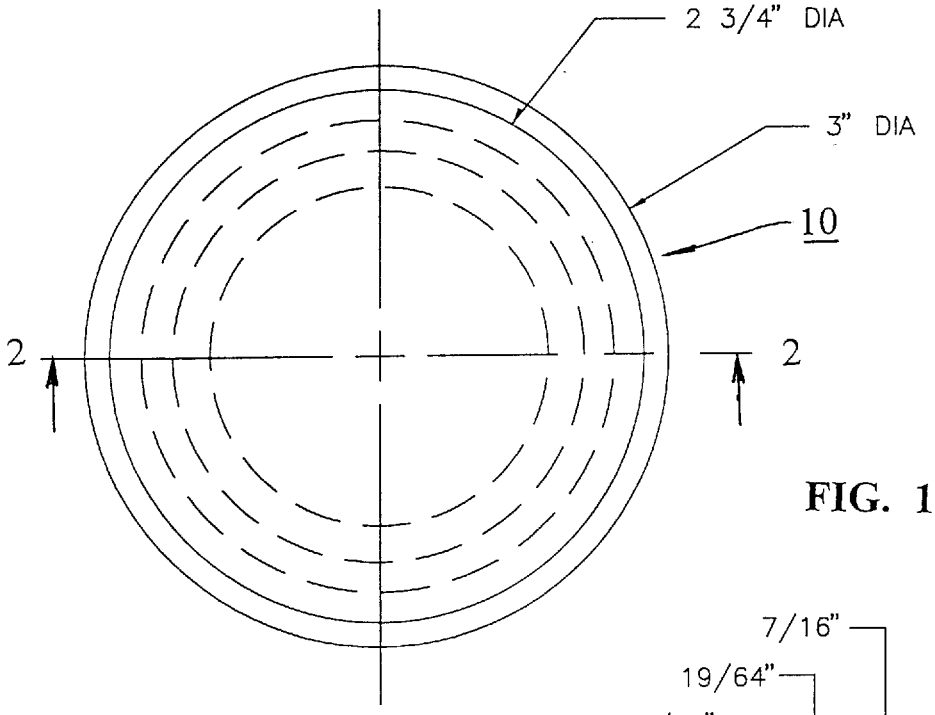
FIG. 1 is a plan view of a puck made in accordance with one embodiment of the present invention.
Figure 2:
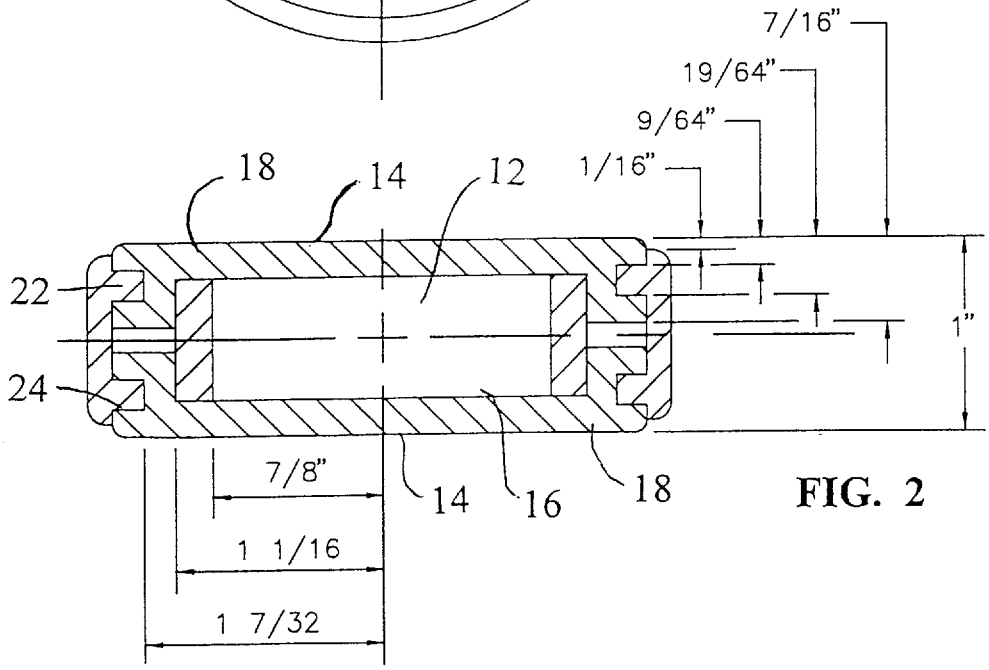
FIG. 2 is a section view of the puck body illustrating typical dimensions for the various puck components.

As best seen in FIG. 2, the puck 10 includes an internal chamber 12 which is of disc-like outline shape extending parallel to the opposing major circular faces 14 of the puck. The chamber 12 contains a mass of material 16 which is movable within the chamber 12 such that the centre of gravity of the puck 10 can be altered, as by application of a force to the puck in a direction generally parallel to the major 14 faces of the puck.

The movable mass of material 16 can comprise a variety of substances provided that they possess the requisite degree of weight or mass. In the particular embodiment shown the movable mass comprises a volume of moderately fine sand which occupies a portion of the volume of chamber 12 (in this case about half the volume) such that the sand can move relatively freely within chamber 12 under the various playing conditions likely to be encountered.

With continued reference to FIG. 2 it will be noted that the puck body comprises a pair of mating halves 18, each having a circular central recess therein which recesses, when said halves 18 are brought together, form said internal chamber 12.

The two halves 18 of the puck are secured together by friction welding and a rubber or Neoprene* band 20 encircles the generally cylindrical sidewall of the puck body as defined by the mating halves 18. This resilient band 20 has a spaced pair of annular ribs 22 on the interior surface of same, each rib 22 engaging in a respective annular groove 24 formed in an associated one of said mating halves 18.

*Reg. Trade Mark

The puck construction described above possesses a number of advantages. Some of these are described in detail below.

1. Shock reduction etc. The exterior rubber band 20 helps reduce shock to the plastic puck body, serves as a grip for the hockey stick blade and cushions the effect on a player who may be accidentally struck by the puck.

Figure 3:
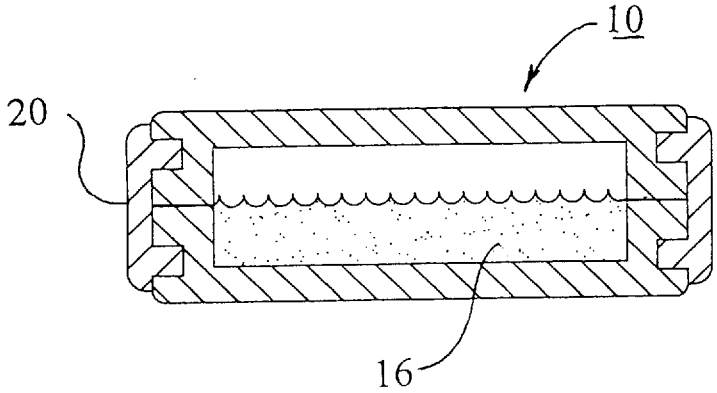
FIGS. 3, 4 and 5 are additional cross-sectional views of the puck illustrating the position of the movable mass of material within the puck internal chamber under various playing conditions.

2. Improved puck stability—During stick handling the internally placed sand spreads over the floor of the chamber (FIG. 3) thus maintaining the centre of gravity close to the playing surface.

3. Anti-rotational effect and balance improvement.

Figure 4:
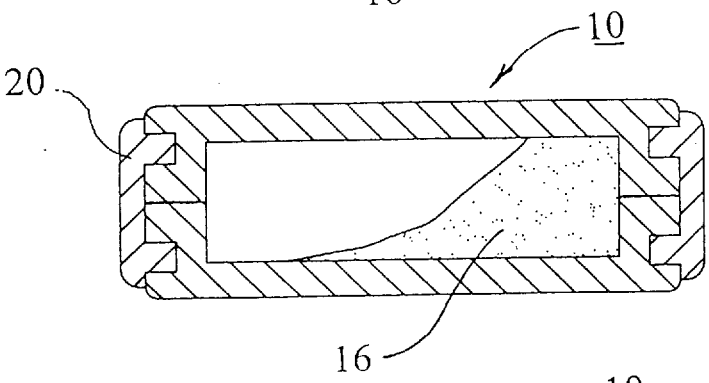

A) At the instant the player's stick strikes the puck 10 most of the sand 16 will flow quickly to the site of the impact causing a reduction in weight on the leading edge of the puck, thereby greatly lessening the tendency for the puck to rotate over its own axis during passing or shooting (FIG. 4).

B) The rubber band 20 on the outer side wall being spaced approximately ⅛ inch above and below the face surfaces of the puck, provides a substantial angle between the edge of the face surface and said rubber band. This greatly diminishes any tendency for the rubber band 20 to contact and exert friction on the playing surface. It is this rubber contact that produces undesirable rotation of the puck during play with a standard hockey puck.

4. Minimum friction effect—The flat, smooth, polyethylene surface of the puck dramatically reduces friction resulting in easy passage of said puck over rough pavement or concrete when used in street hockey. In use, when the puck is handled by a hockey stick, less effort on the part of the hockey player is required to start puck motion as there is very little resistance or friction at the weight bearing surface provided by the low friction plastic puck body. This advantage results in faster, more effective and accurate shots, especially shots taken at odd angles and during passing manoeuvres.

5. Another advantage is that the puck, because of its ease of movement, is always out in front of the player resulting in less effort when stick handling rather than having to be continually pushing it forward and running the risk of over skating it in certain situations.

6. Another advantage of the polyethylene puck face surface is that there will be minimal friction when a fast spin is applied to the puck on long passes, especially in the cases where shots are made into the opposing end along the boards by the blue line. When the puck is shot from the blue line along the boards and down the other side of the rink as described previously, the puck will travel about a ½ rink length further than the traditional rubber puck.

Figure 5:
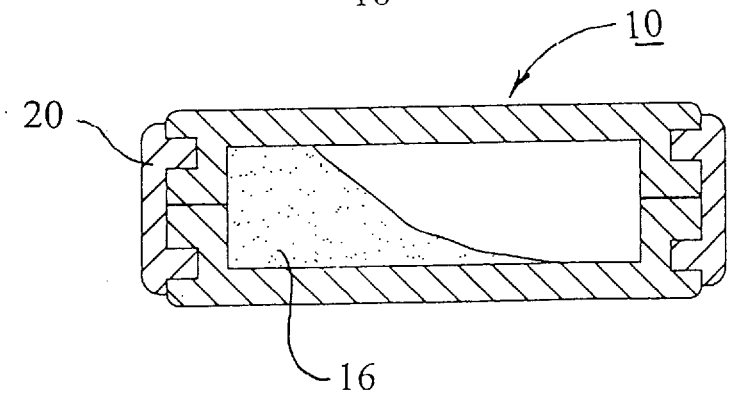

7. Lessening of overall impact when the puck contacts an object or person. The puck body itself with its reduced weight produces the first impact followed by the chamber content causing the second impact as momentum throws the sand to the front of the chamber of the stopped puck (FIG. 5). The fact that the chamber content is of granular consistency rather than a solid mass further softens the second stage puck impact force. It is reasonable to assume that this two-stage impact reduces the maximum impact thus resulting in less destruction than a solid weighted puck would cause under similar circumstances.

8. The internal chamber 12 can also be used to hold various metal substances in particulate form to vary the overall weight of said puck rendering it efficient and comfortable to players of various ages and proficiency.

The present invention may be embodied in other specific forms without departing from the spirit or essential attributes thereof and it is therefore desired that the present embodiment be considered in all respects as illustrative and not restrictive, reference being made to the appended claims rather than the foregoing description to indicate the scope of the invention.

We claim:

1. A puck for playing hockey and hockey-like games on a variety of surfaces, said puck having a body of generally cylindrical shape with opposed major faces and having an internal chamber therein containing a mass which is movable within said chamber whereby the centre of gravity of said puck can be altered, as by application of a force to said puck in a direction generally parallel to said major faces, said internal chamber being of disc-like outline shape extending generally parallel to the major faces of the puck, and said movable mass comprising particulate material which occupies a portion only of the volume defined by said chamber, said puck body comprising a pair of mating halves, each having a circular recess therein which, when said halves are brought together, form said internal chamber, and wherein said puck body has a generally cylindrical sidewall extending between said major faces, and a resilient band extending tightly around said sidewall and having a spaced pair of annular ribs on an interior surface thereof each engaging a respective groove formed in an associated one of said mating halves.

2. The puck according to claim 1 wherein said particulate material comprises sand.

3. The puck according to claim 1 wherein the body of the puck is of a low friction plastics material.

* * * * *